US010364951B2

(12) United States Patent
McMillan

(10) Patent No.: US 10,364,951 B2
(45) Date of Patent: Jul. 30, 2019

(54) UNIVERSAL DOWN LIGHT BEZEL MOUNTING SYSTEM

(71) Applicant: George Erik McMillan, Hickory, NC (US)

(72) Inventor: George Erik McMillan, Hickory, NC (US)

( * ) Notice: Subject to any disclaimer, the term of this patent is extended or adjusted under 35 U.S.C. 154(b) by 47 days.

(21) Appl. No.: 14/609,569

(22) Filed: Jan. 30, 2015

(65) Prior Publication Data

US 2015/0211699 A1 Jul. 30, 2015

Related U.S. Application Data

(60) Provisional application No. 61/933,821, filed on Jan. 30, 2014.

(51) Int. Cl.

| | |
|---|---|
| ***F21S 8/02*** | (2006.01) |
| ***F21V 21/04*** | (2006.01) |
| *F21Y 115/10* | (2016.01) |

(52) U.S. Cl.

CPC ..... *F21S 8/026* (2013.01); *F21V 21/047* (2013.01); *F21Y 2115/10* (2016.08); *Y10T 29/49826* (2015.01); *Y10T 29/49963* (2015.01)

(58) Field of Classification Search

CPC .. F21S 8/02; F21S 8/026; F21V 21/04; F21V 21/041; F21V 21/042; F21V 21/043; F21V 21/044; F21V 21/045; F21V 21/046; F21V 21/047; F21V 21/048; F21V 21/049

See application file for complete search history.

(56) References Cited

U.S. PATENT DOCUMENTS

| | | | | |
|---|---|---|---|---|
| 2,518,936 A * | 8/1950 | Roberts | F21S 8/02 | 248/27.1 |
| 2,614,785 A * | 10/1952 | Versen | F21V 21/04 | 248/27.1 |
| 3,666,040 A * | 5/1972 | Junk | H04R 1/025 | 181/150 |
| 4,039,822 A * | 8/1977 | Chan | F21S 8/02 | 362/183 |
| 4,048,491 A * | 9/1977 | Wessman | F21V 21/04 | 248/343 |
| 4,930,054 A * | 5/1990 | Krebs | F21S 8/026 | 315/118 |

(Continued)

FOREIGN PATENT DOCUMENTS

DE 4202295 C1 * 7/1993

*Primary Examiner* — Robert J May

(74) *Attorney, Agent, or Firm* — Murphy, Bilak & Homiller, PLLC

(57) ABSTRACT

A light-mounting system includes an outer bezel configured for being secured to a ceiling, a light-emitting device configured for being received in a recess in the ceiling above the outer bezel, and an inner bezel configured for being secured to the light-emitting device below and through at least a portion of the outer bezel such that the outer bezel is retained between the light emitting device and the inner bezel. A method of installing a light-mounting system includes placing a light-emitting device into engagement with a back portion of an outer bezel, placing an inner bezel into engagement with a front portion of the outer bezel, and fastening the light-emitting device into engagement with the inner bezel to thereby sandwich the outer bezel.

13 Claims, 6 Drawing Sheets

(56) References Cited

U.S. PATENT DOCUMENTS 6,474,846 B1 * 11/2002 Kelmelis ..... F21V 17/164
248/231.91
6,588,922 B1 * 7/2003 DeCicco ..... F21V 21/04
362/148
7,748,887 B2 * 7/2010 Zampini, II ..... B63B 45/06
362/147

* cited by examiner

UNIVERSAL DOWN LIGHT BEZEL MOUNTING SYSTEM

CROSS-REFERENCE TO RELATED APPLICATION

This application claims the benefit of priority of U.S. provisional patent application No. 61/933,821, titled "UNIVERSAL RECESSED LIGHT-MOUNTING SYSTEM," filed on Jan. 30, 2015, which is incorporated herein in its entirety by this reference.

TECHNICAL FIELD

The present disclosure relates to a universal recessed light-mounting system, and more particularly, towards a universal recessed light-mounting system that is useful, for example, when retrofitting existing recessed lights.

BACKGROUND

In the lighting industry, recessed "can" type lights are very popular. The lights may vary in size, from having a diameter of three inches to a diameter of 19 inches, and in some cases, even larger diameters. Many of these cans are being "retrofitted" from their existing light source (halogen, florescent, incandescent, etc) to more energy efficient LED lights. This retrofit process poses many issues when it comes to matching the recess hole openings, can sizes, and can designs.

What is needed is a system that has the capability to fit multiple sizes with a single part. Currently in the industry there are a couple of "multi-fit" light systems, or a "universal can" that can fit several can sizes within a one inch diameter size difference (e.g. between four inches and five inches), as long as one is replacing with the specific type of can enclosure. If the existing can enclosure does support a "clip" mount application, such a multi-fit can is not suitable.

This problem is one of a growing number of concerns due to scheduled and anticipated retrofits for many municipalities and large corporate venues. In such venues, there may be many differently sized light assemblies that are being retrofit in any given project. A contractor must either have suitable quantities on hand of each given sized light kit or painstakingly calculate exact numbers of a given dimension of lights in order to budget for and complete a retrofit project.

Accordingly, a method or good configuration to address these disadvantages is needed.

SUMMARY

This Summary is provided to introduce in a simplified form concepts that are further described in the following detailed descriptions. This summary is not intended to identify key features or essential features of the claimed subject matter, nor is it to be construed as limiting the scope of the claimed subject matter.

According to one or more embodiments, a light-mounting system is provided. The system includes an outer bezel configured for being secured to a ceiling, a light-emitting device configured for being received in a recess in the ceiling, and an inner bezel configured for being at least partially received by the outer bezel and engaging the light-emitting device.

According to one or more embodiments, an outer bezel frame defines one or more apertures through which a fastener extends in order to secure the outer bezel to the ceiling.

According to one or more embodiments, each of the outer bezel, light-emitting device, and inner bezel define a circular outer shape. However, the shape of each may be of any design such as square or hexagon if so desired, so as to meet or create an aesthetic statement.

According to one or more embodiments, the outer bezel defines a retaining shoulder extending therefrom that is sized to receive the outer circumference of the inner bezel.

According to one or more embodiments, the light-emitting device includes a circumferentially extending shoulder having at least one tab extending therefrom, the tab defining an aperture through which a fastener extends, and further wherein the inner bezel defines an inner threaded portion configured for receiving the aperture and securing the inner bezel to the light-emitting device.

According to one or more embodiments, the outer bezel is sandwiched between the inner bezel and the light-emitting device when the system is installed about a ceiling.

According to one or more embodiments, the one of the light and the inner bezel defines a fastener for fastening the other of the light and inner bezel into engagement therewith.

According to one or more embodiments, the inner bezel and the outer bezel are integrally formed.

According to one or more embodiments, a method of installing a light-mounting system, the method comprising: placing a light-emitting device into engagement with a back portion of an outer bezel; placing an inner bezel into engagement with a front portion of the outer bezel; and fastening the light-emitting device into engagement with the inner bezel to thereby sandwich the outer bezel.

According to one or more embodiments, the method further includes placing the light-emitting device into a recess defined in the ceiling and further including securing the outer bezel to the ceiling by a threaded fastener.

According to one or more embodiments, the method further includes placing a gasket material between the outer bezel and the ceiling.

BRIEF DESCRIPTION OF THE DRAWINGS

The previous summary and the following detailed descriptions are to be read in view of the drawings, which illustrate particular exemplary embodiments and features as briefly described below. The summary and detailed descriptions, however, are not limited to only those embodiments and features explicitly illustrated.

DETAILED DESCRIPTIONS

These descriptions are presented with sufficient details to provide an understanding of one or more particular embodiments of broader inventive subject matters. These descriptions expound upon and exemplify particular features of those particular embodiments without limiting the inventive subject matters to the explicitly described embodiments and features. Considerations in view of these descriptions will likely give rise to additional and similar embodiments and features without departing from the scope of the inventive subject matters.

Some of the drawings indicate particular exemplary dimensional measurements in inches. Such examples do not limit the subject matter represented to the measurements indicated. Thus, some embodiments within the scope of these descriptions do not exhibit the measurements given. However, some embodiments within the scope of these descriptions do exhibit one or more of the measurements given. Furthermore, the drawings are not necessarily drawn to scale. Some embodiments with the scope of these descriptions however do correspond to the apparent scale of the drawings, while other embodiments do not.

Figure 1:
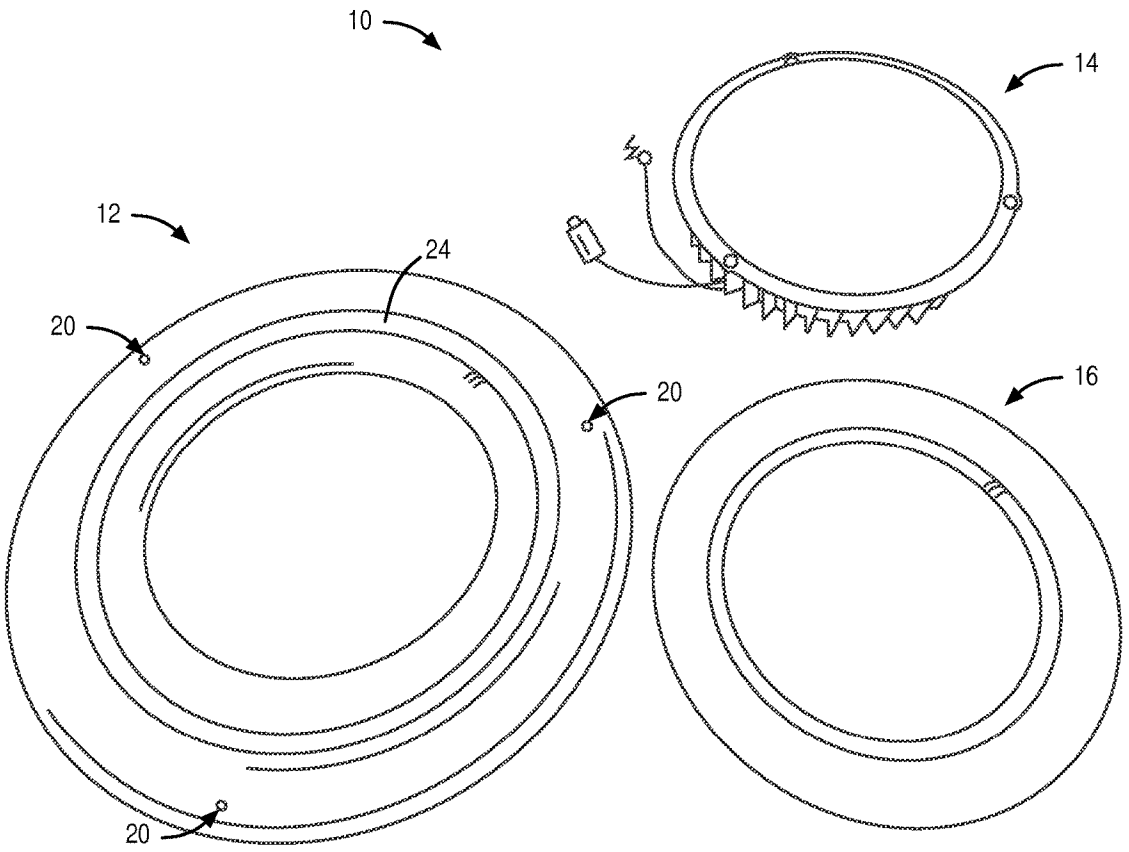
FIG. 1 is perspective view of a light-mounting system according to one or more embodiments disclosed herein.

With reference to all of the drawings and further specific reference to FIG. 1, a light-mounting system is provided and generally designated 10. The light-mounting system 10 may be packaged as a kit containing each of the illustrated items or individual components may be provided in certain circumstances. In one or more embodiments, the light-mounting system 10 may be employed for retrofitting an existing light system, such as, in the example of retrofitting a conventional recessed lighting system with a more energy efficient lighting device such as an LED based device.

Figure 2:
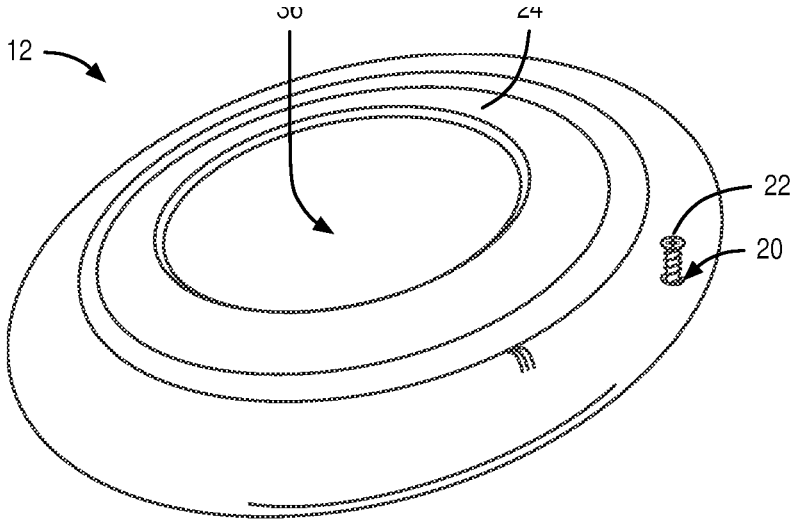
FIG. 2 is a perspective view of an outer bezel of the light-mounting system of FIG. 1.

The light-mounting system 10 may include an annular outer bezel 12 configured for being secured to a ceiling. The outer bezel 12 is illustrated being made from a plastic material, but any suitably desired material may be employed, including, for example, aluminum or other metallic material. The outer bezel 12 may define a generally flat upper surface, shown as directed toward the ceiling 40 in FIG. 5A, that is configured for being engaged to a ceiling. The flat upper surface may further include a gasket or insulating material for limiting marking on the ceiling and for providing air sealed engagement. The outer bezel 12 may have a generally ornate, arcuate bottom facing surface, as shown in FIGS. 1 and 2, that further defines a retaining shoulder 24 extending therefrom. The retaining shoulder 24 is shown at a medial portion of the outer bezel 12, though shoulder 24 may be defined at any desired position. The retaining shoulder 24 is illustrated extending around an entire circular portion of the outer bezel 12, though a lesser amount of material may be utilized for the retaining shoulder 24. With further reference to FIG. 2, the outer bezel frame 12 defines one or more apertures 20 through which a fastener 22 extends in order to secure the outer bezel 12 to the ceiling. Fastener 22 may be any appropriately provided fastener. While illustrated as a screw, fastener 22 could be a toggle bolt, wing nut bolt, stud screw, drywall screw, bolt and nut assembly, tape, glue, and the like.

System 10 further includes a light-emitting device 14 configured for being received in a recess in the ceiling. The light-emitting device 14 may be an LED light as illustrated and may contain one or more pigtail electrical contacts/wires for connecting to an electric connector for supplying power thereto. The light-emitting device 14 may be any sized light configured for being received within a recess and "can" formed in a ceiling. As used herein, can is meant to refer to an enclosure assembly positioned in a ceiling that is configured for receiving a light.

Figure 4:
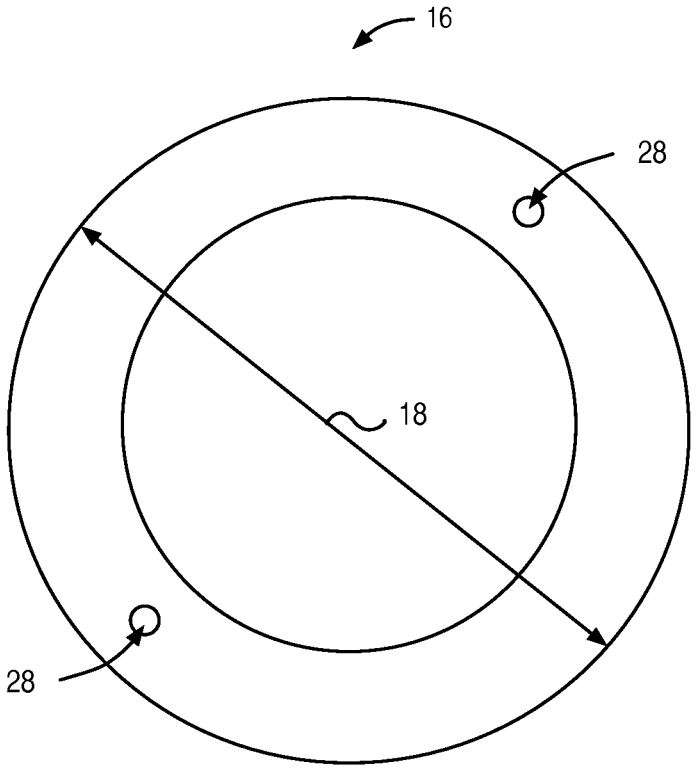
FIG. 4 is a bottom view of the inner bezel of the light-mounting system FIG. 1.

The system 10 further includes an annular inner bezel 16 configured for being received by the outer bezel 12 and for engaging the light-emitting device 14. The inner bezel 16 is illustrated as having a donut shape and an outer diameter 18 (FIG. 4) or other peripheral dimension that generally corresponds to the inner dimension formed by the shoulder 24 of outer bezel 12.

Figure 3:
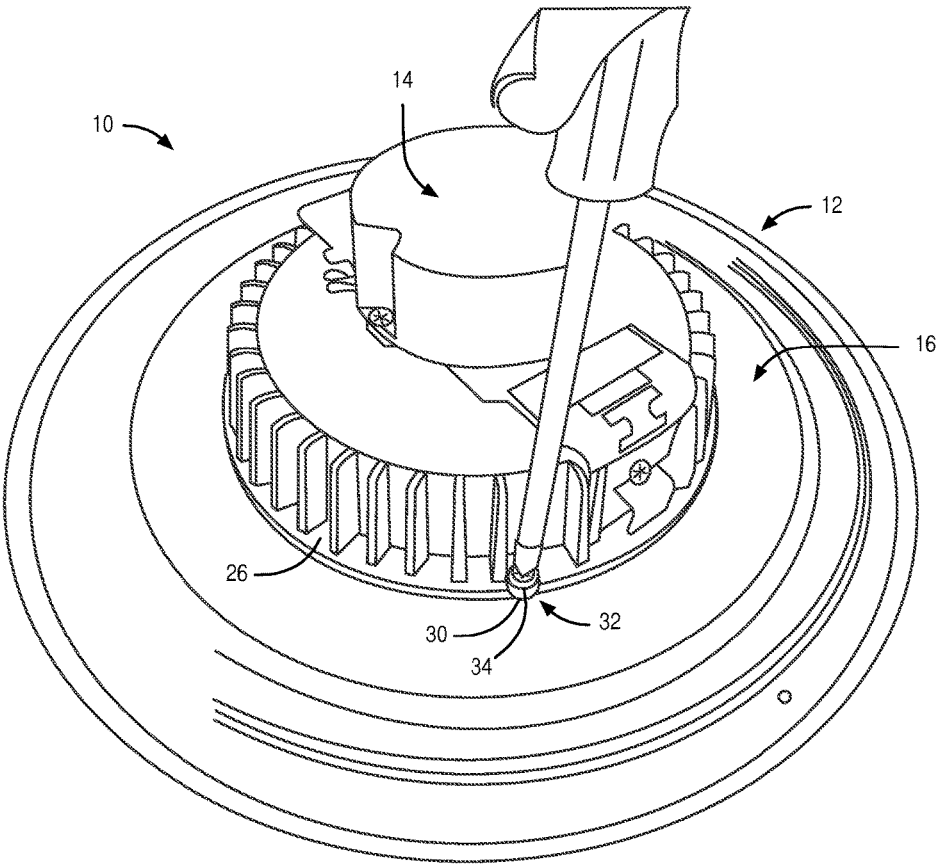
FIG. 3 is a perspective view of the light-mounting system FIG. 1 under assembly.

With further reference to FIG. 3, the light-emitting device 14 includes a circumferentially extending shoulder 26 having at least one tab 30 extending therefrom. The tab 30 of the light-emitting device 14 defines an aperture 32 through which a fastener 34 can be extended. The inner bezel 16 defines an inner threaded hole 28 (FIG. 4) that is configured for receiving the fastener to secure the inner bezel 16 to the light-emitting device 14 (FIG. 3).

Figure 5A:
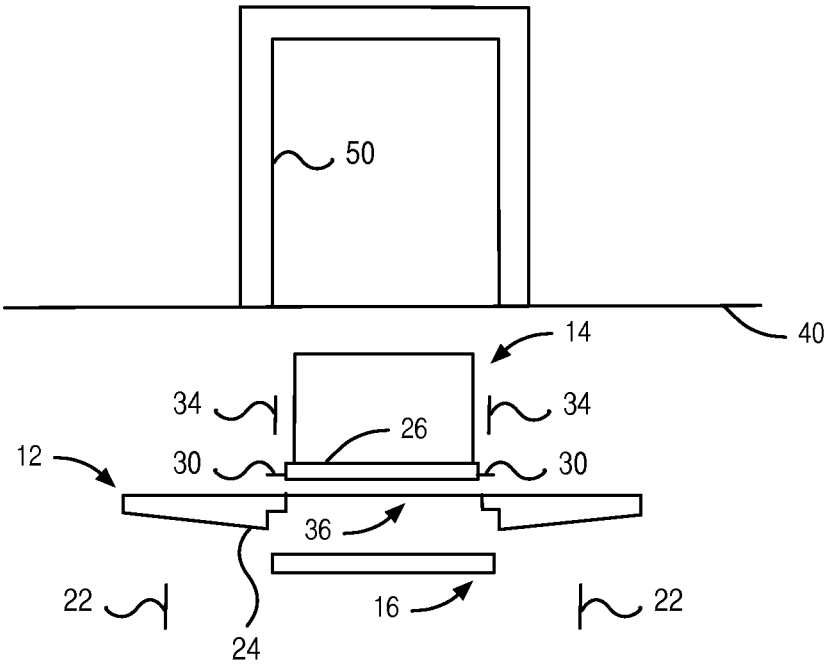
FIG. 5A is an exploded side view of the light mounting system of FIG. 1.
Figure 5B:
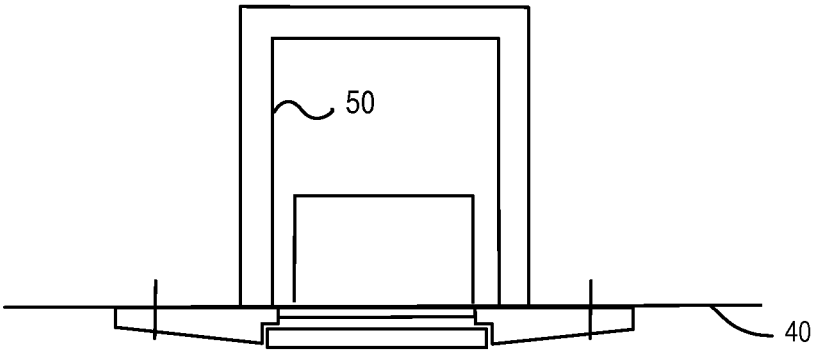
FIG. 5B is an assembled side view of the light mounting system of FIG. 1.
Figure 6:
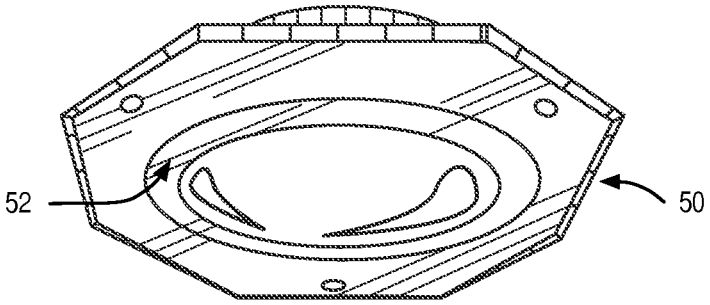
FIG. 6 is a bottom perspective view of a light mounting system, according to at least one embodiment, having an outer bezel with a polygonal outer shape.

During assembly, the outer bezel 12 is sandwiched between the inner bezel 16 and the light-emitting device 14 as shown in FIG. 5A when the light-mounting system 10 is to be installed about a ceiling 40. Specifically, with further reference to FIG. 5B, the light-mounting system 10 is shown installed in a can 50 positioned within a recess defined in the ceiling 40. The fastener 34 extends through tab 30 and into engagement with the inner bezel 16. The inner bezel 16 has the outer diameter 18 (FIG. 4) or other peripheral dimension that is greater than the opening 36 of the outer bezel 12, thereby contacting the outer bezel 12, preventing the inner bezel 16 from passing through the opening 36, and engaging all components together. Fasteners 22 are then extended through the outer bezel 12 into engagement with the ceiling 40, thereby securing light-mounting system 10 to the ceiling. In this manner, fastener 22 is load bearing for the entire assembly 10.

The outer bezel 12 can be any size needed. In at least one example, the outer bezel 12 has an outer diameter of eight inches. In another example, the outer bezel 12 has an outer diameter of ten inches.

In one or more embodiments, the inner bezel 16 and the outer bezel 12 are integrally formed or pre-assembled together as a consolidated bezel and the light-emitting device 14 engages the consolidated bezel with a fastener such as a threaded fastener that extends through tab 30 of the light emitting-device 14.

In one or more embodiments, a gasket material is provided for being placed between one of the outer bezel or inner bezel and the ceiling. The gasket material provides insulating characteristics and also prevents marring or other deformation of the ceiling. Any resilient material or material having desired characteristics may be used for the gasket material. A spacer may also be included for placement between the outer bezel and ceiling.

Although the outer bezel, light-emitting device, and inner bezel are shown in the above-described drawings as each having a generally circular outer shape, the shape of each may be of any design, including polygons such as squares and hexagons, if so desired, so as to meet or create an aesthetic statement. For example, an outer bezel 50 is shown as having an octagon shaped outer perimeter, with an inner bezel 52 being circular.

The above-described assemblies are particularly useful in retrofit situations, however, the systems and products disclosed herein may also be used in new construction or in placing a new installation.

Particular embodiments and features have been described with reference to the drawings. It is to be understood that these descriptions are not limited to any single embodiment or any particular set of features, and that similar embodiments and features may arise or modifications and additions may be made without departing from the scope of these descriptions and the spirit of the appended claims.

What is claimed is:

1. A light-mounting system comprising:

an outer bezel configured for being secured to a ceiling;

a light-emitting device configured for being received in a recess in the ceiling above the outer bezel; and an inner bezel configured for being secured to the light-emitting device below and through at least a portion of the outer bezel such that the outer bezel is retained between the light emitting device and the inner bezel.

2. The system of claim 1, wherein the outer bezel defines one or more apertures for extending a fastener therethrough to secure the outer bezel to the ceiling.

3. The system of claim 1, wherein each of the outer bezel, light-emitting device, and inner bezel define a circular outer shape.

4. The system of claim 1, wherein the outer bezel defines a retaining shoulder extending sized to receive an outer circumference of the inner bezel.

5. The system of claim 1, wherein the light-emitting device includes a circumferentially extending shoulder having at least one tab extending therefrom, the tab defining an aperture for extending a fastener therethrough, and further wherein the inner bezel defines an inner threaded portion configured for receiving and engaging the fastener and securing the inner bezel to the light-emitting device.

6. The system of claim 5, wherein the outer bezel is sandwiched between the inner bezel and the light-emitting device when the system is installed about the ceiling.

7. The system of claim 1, wherein one of the light-emitting device and the inner bezel defines a fastener for fastening the other of the light-emitting device and inner bezel into engagement.

8. The system of claim 1, wherein the inner bezel and the outer bezel are integrally formed.

9. The system of claim 1, further including a gasket material for being placed between one of the outer bezel or inner bezel and the ceiling.

10. A light-mounting system, comprising:

a bezel configured to be fastened to a bottom side of a ceiling, with a bottom surface of the bezel exposed; and a light-emitting device configured to be received in a recess in the ceiling above the bezel, wherein the light-emitting device is configured to be fastened on a top surface of the bezel such that the load for the light-mounting system is borne by the bezel being fastened to the bottom side of the ceiling.

11. The light-mounting system of claim 10, wherein the bezel comprises one or more apertures for extending one or more fasteners through the exposed bottom surface of the bezel into the ceiling to fasten the bezel to the bottom side of the ceiling, wherein the one or more fasteners bear the load of the light-mounting system.

12. The light-mounting system of claim 11, wherein the one or more apertures are positioned in the bezel so as to be spaced apart from the recess in the ceiling.

13. A method of installing a light-mounting system, the light-mounting system comprising a bezel and a light-emitting device, the method comprising:

fastening the light-emitting device to the bezel; and fastening the bezel to a bottom side of a ceiling using fasteners that pass through one or more apertures of the bezel into the bottom side of the ceiling, such that the light-emitting device is recessed into the ceiling and the load for the light-mounting system is borne by the bezel being fastened to the bottom side of the ceiling, wherein fastening the light-emitting device to the bezel comprises extending one or more fasteners through inner threaded portions of the bezel to one or more tabs of a circumferentially extending shoulder of the light-emitting device.

* * * * *